United States Patent [19]

Penven

[11] Patent Number: 4,806,208

[45] Date of Patent: Feb. 21, 1989

[54] METHOD OF SEAMING A SEAMED FELT ON A PAPERMAKING MACHINE WITH OPPOSITELY TAPERED PINTLE ELEMENTS

[75] Inventor: Patrick Penven, Clinton, S.C.

[73] Assignee: Asten Group, Inc., Charleston, S.C.

[21] Appl. No.: 108,376

[22] Filed: Oct. 14, 1987

[51] Int. Cl.[4] ..... D06H 5/00; F16G 3/02

[52] U.S. Cl. ..... 162/199; 24/33 P; 24/33 C; 139/383 A; 162/DIG. 1; 245/10

[58] Field of Search ..... 162/348, 358, DIG. 1, 162/199, 200; 139/383 AA, 383 A; 245/10; 24/31 R, 33 A, 33 B, 33 C, 33 M, 33 P, 33 R, 576, 136 R, 130; 28/141, 142; 403/368; 198/844; 66/1 A

[56] References Cited

U.S. PATENT DOCUMENTS

| | | | |
|---|---|---|---|
| 1,404,595 | 1/1922 | Gibson | 24/33 B |
| 1,723,114 | 8/1929 | Young . | |
| 1,975,862 | 10/1934 | Olsen | 24/33 |
| 1,998,135 | 4/1935 | Heinz | 24/33 |
| 2,002,897 | 5/1935 | Kremer | 24/33 |
| 2,012,071 | 8/1935 | Rhoades | 24/33 |
| 2,020,542 | 11/1935 | Freedlander | 24/33 B |
| 2,034,828 | 3/1936 | Olsen | 24/33 |
| 2,084,490 | 6/1937 | Hooper | 24/33 |
| 2,145,455 | 1/1939 | Olsen | 24/33 B |
| 2,587,053 | 2/1952 | Lopez | 24/33 |
| 2,629,909 | 3/1953 | Hall | 24/33 |
| 2,883,734 | 4/1959 | Draper, Jr. | 24/33 C |
| 3,335,844 | 8/1967 | Hindle et al. | 198/193 |
| 3,668,742 | 6/1972 | Bartman | 24/33 C |
| 3,735,451 | 5/1973 | Haythornthwaite | 24/33 |
| 3,831,297 | 8/1974 | Lanz et al. | 403/368 |
| 4,007,303 | 2/1977 | Schuster et al. | 427/296 |
| 4,138,864 | 2/1979 | Bennett | 66/1 A |
| 4,250,822 | 2/1981 | Fickers | 112/262.1 |
| 4,344,209 | 8/1982 | Harwood | 24/31 |
| 4,364,421 | 12/1982 | Martin | 24/33 C |
| 4,418,726 | 12/1983 | Josef et al. | 139/383 |

*Primary Examiner*—David L. Lacey
*Assistant Examiner*—K. M. Hastings
*Attorney, Agent, or Firm*—Volpe & Koenig

[57] ABSTRACT

A pintle unit and method of closing a seam in a papermakers felt which provides a tight closure along the full length of the seam. The seam is closed with a pintle unit made up of a plurality of pintle elements which are tapered and pulled into the seam to interact in a wedging fashion. The pintle elements are tapered for a length at least as long as the width of the seam so that when wedged in the seam a pintle unit of substantially uniform size across the full width of the felt is provided.

11 Claims, 2 Drawing Sheets

FIG.3
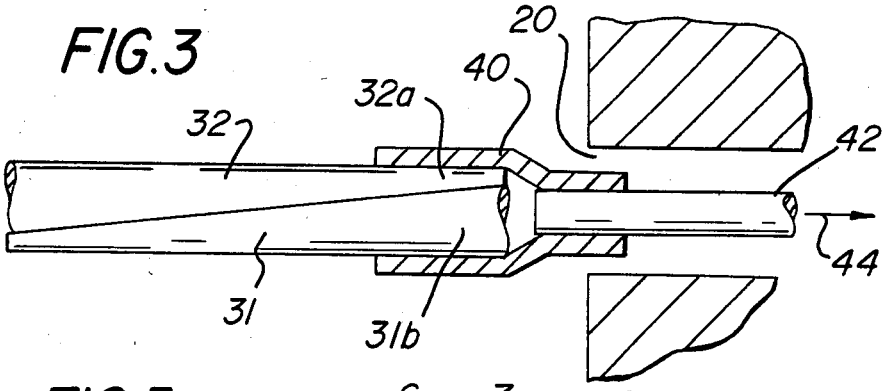
FIG.5
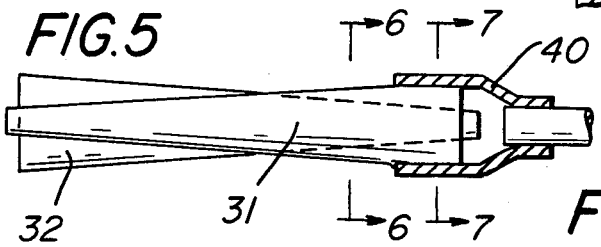
FIG.6
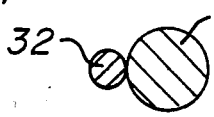
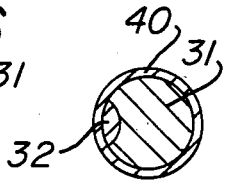
FIG.7
FIG.8
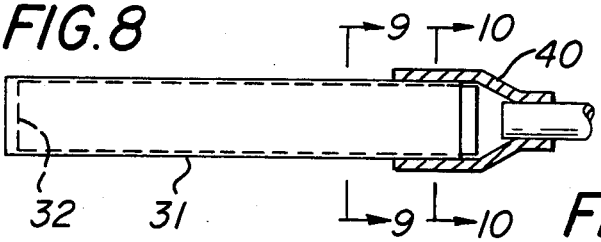
FIG.9
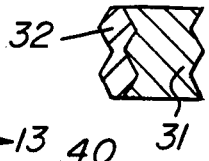
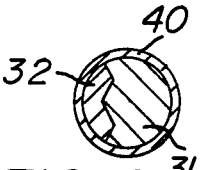
FIG.10
FIG.11
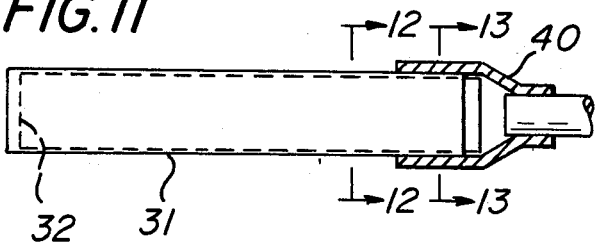
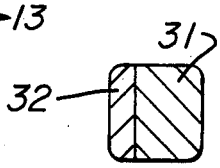
FIG.12
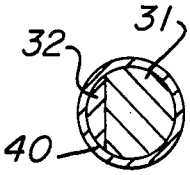
FIG.13

METHOD OF SEAMING A SEAMED FELT ON A PAPERMAKING MACHINE WITH OPPOSITELY TAPERED PINTLE ELEMENTS

BACKGROUND OF THE INVENTION

The present invention relates to the field of papermaking machine felts, and more particularly to methods of forming a seam in a papermakers felt. In papermaking machines, an endless felt structure is supported on and advanced by various machine rolls during the papermaking process. In the papermaking process, such endless felts are employed in a number of capacities such as forming fabrics, as wet press felts and as drying felts. The felts may be woven as endless felts, however, the use of a seam to join the ends of a flat felt into an endless felt is often desirable.

The use of a seam to join the ends of a flat felt is known in the art. Such seams typically include loops or hooks on the end of the felt which are aligned in an alternatingintermeshing relationship and a pintle connector which is inserted through the aligned loops or hooks to close the seam.

The use of metal clips affixed to a seam webbing to form a clipper seam is disclosed in U.S. Pat. No. 4,344,209. The formation of loops, integral with the ends of a flat papermaker's felt through which a pintle can be inserted to join the ends of the felt is disclosed in U.S. Pat. No. 2,883,734.

The use of a pair of shaped pintles freely moveable with respect to one another which each have a convexly curved profile when viewed in cross section, which are inserted through a series of spaced apart loops affixed to the ends of a felt to be joined is disclosed in U.S. Pat. No. 3,668,742. The use of shaped joining elements is shown in the connection of conveyor belt ends by insertion through loops formed by hook members clamped to the belt ends, in U.S. Pat. Nos.: 2,002,897; 2,012,071; and 2,020,542.

As papermaking machines have developed, felts approaching 400 inches in width have come into use. Additionally, over the years, the speed of operation of the felts in such papermaking machines has increased and can often approach the 4 to 5 thousand feet per minute range. Because the felts are threaded around various guides, cylinders, rollers and between presses and further maintained under tension, the strength and durability of a seam becomes a prime consideration. The use of a seam allows for ease of installation of the felt in the papermaking machine. However, the high speed, and conditions of operation, pressure, temperature and moisture, that a seam is exposed to often result in extreme conditions of wear at such seams.

The use of havy pintles which requires increasing the diameter of the loops through which the pintle is inserted can increase seam reliability. However, the resultant increased thickness of the felt at the seam can result in undesirable marking and/or irregularities in the paper product being produced. To control lateral, twisting movement of the felt ends which are joined, a tight fit between the pintle and the seam is desirable.

SUMMARY OF THE INVENTION

The present invention provides a improved method of closing the seam of a papermaker's felt and an improved pintle design which provides a seam having improved strength, marking resistance and resistance to wear. The seam is produced by forming a series of intregal loops in the ends of a flat felt which are to be joined. The intregal loops are formed such that the loops of the two ends to be joined will alternately intermesh when the ends are mated. The intermeshed loops form an opening through which a connecting pintle may be inserted. This formation of intermeshed loops is known in the art. The pintle of the present invention comprises two complementary pintle elements which are shaped, in cross section, so as to interfit within the opening through which the pintle elements are inserted to form a pintle unit. The elements are inserted so as to interact within the opening and work as a pintle unit when fully inserted.

The pintle elements are shaped so that they may be inserted through a seam and brought into increasing complementary contact to securely close the seam as a pintle unit. The use of shaped complementary pintle elements which interact within the seam allows for a tight fit between the pintle unit and the loops and provides a relatively easy pintle unit to insert.

BRIEF DESCRIPTION OF THE DRAWINGS

FIG. 3 is a plan view, illustrating, in section a pintle of the present invention.

FIG. 5 is a plan view of an alternate embodiment of a pintle unit for joining a papermaker's felt in accordance with the present invention.

FIG. 6 is a cross section along line 6—6 of FIG. 5.

FIG. 7 is a cross section along line 7—7 of FIG. 5.

FIG. 8 is a plan view of an alternate embodiment of a pintle unit for joining a papermaker's felt in accordance with the present invention.

FIG. 9 is a cross section along line 9—9 of FIG. 8.

FIG. 10 is a cross section along line 10—10 of FIG. 8.

FIG. 11 is a cross section of an alternate embodiment of a papermaker's felt joined in accordance with the present invention.

FIG. 12 is a cross section along line 12—12 of FIG. 11.

FIG. 13 is a cross section along line 13—13 of FIG. 11.

DESCRIPTION OF THE PREFERRED EMBODIMENT

Figure 1:
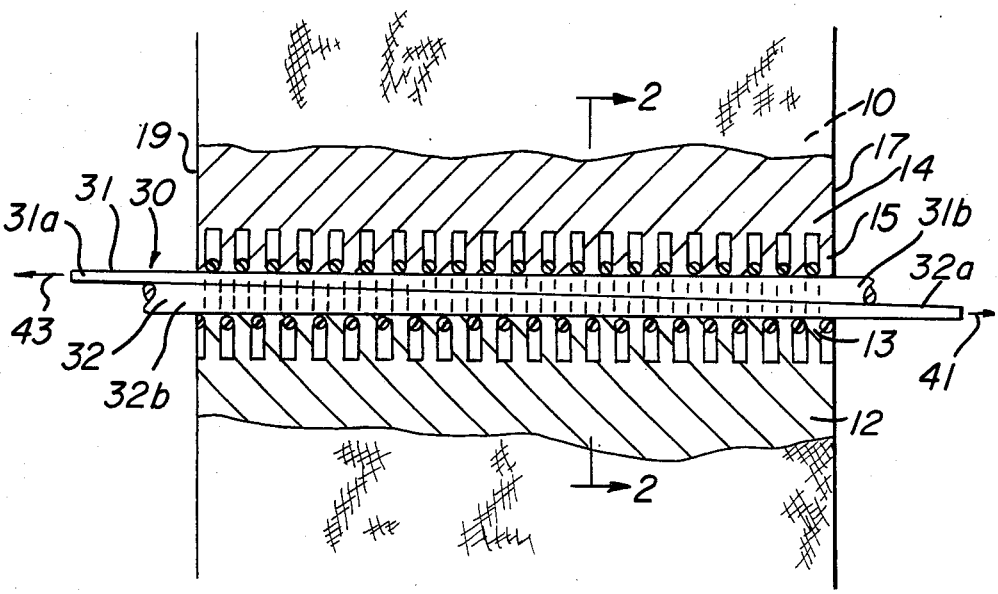
FIG. 1 is a plan view, partially in section of the papermaker felt joined in accordance with the present invention.

Although specific forms of th invention have been select for illustration in the drawings, and the following description is drawn in specific terms for the purpose of describing these forms of the invention this description is not intended to limit the scope of the invention which is defined in the appende claims.

The improved method of seaming a papermaker,s fabric of the present invention is intended primarily for use in joining the ends of a papermaker's wet felt to form an endless felt. A typical papermaker's wet felt is constructed of a base fabric, either single or multiple ply onto which a layer or layers of non-woven batts are needled. The various configurations of the base fabric and the manner by which the batts are needled thereto are well known in the art and form no part of the present invention. While the present invention is described with respect to a single layer base fabric having intregal loops formed at the ends to be joined, the present invention can be easily adapted for use with multi-layer base fabric and in combination with base fabrics to which loops have been added to the ends to be joined.

Referring now to the drawings, and particularly to FIG. 1, a plan view, partially in cross section, of the invention is shown. The papermaker,s felt 10 is formed in a conventional manner of a base fabric 11 having a first end 12 and a second end 14. Spaced apart loops 13 are formed at end 12 so as to alternately intermesh with loop 15 formed at end 14 when the ends 12 and 14 are aligned adjacent each other to form an endless felt.

Orientation of loops 13 and 15 in this alternating intermeshing arrangement forms a substantially tubular passageway 20 through which a locking element or pintle may be inserted. Insertion of a pintle through passageway 20 effectively closes the seam and provides the desired endless felt.

In closing a seam for a papermaker's felt in accordance with the present invention, the pintle unit 30 is made up of two independent-complementary pintle elements 31 and 32. The pintle elements 31 and 32 are tapered or shaped for at least a portion of their length. The tapered portion of pintle elements 31 and 32 may be conical in cross section, FIG. 5, or include a flat or geometric surface which is tapered, FIGS. 2, 4, 9, and 12. As can be seen from the figures, the pintle elements 31 and 32 are shaped to interfit and are oppositely tapered along their longitudinal axis. The complementary shape serves to unite the pintle elements and the tapered configuration serves to tighten the seam as will be described hereinafter.

The pintle elements 31 and 32 are preferable inserted by affixing a swedge 40 to ends 32*a* and end 31*b* of pintle elements 31 and 32 respectively. An insertion wire or lead 42 is also joined to swedge 40. Insertion wire 42 is inserted through the seam, arrow 44, and used to pull pintle elements 31 and 32 through the seam, FIG. 3. The orientation of pintle elements when joined by swedge 40 is such that the pintle unit 30 is of a diameter which is less than the diameter of seam passageway 20, FIG. 3, and may be easily pulled through the seam passageway 20.

Preferably the pintle elements 31 and 32 are inserted simultaneously through the passageway 20. Alternately, pintle elements 31 and 32 may be inserted separately from opposite edges of the papermaker's felt.

Refering to FIG. 1, the pintle elements 31 and 32 are tapered from a first relatively thin first end 31*a* and 32*a* respectively to a relatively thick body portion 31*b* and 32*b* respectively. The length of the tapered portion of each pintle element 31 and 32 is preferably wider than the width of the felt to be seamed.

By providing the pintle elements 31 and 32 with a taper which is longer than the width of the seam to be closed, a tight closure can be provided. In order to control twisting movement of the pintle unit in the seam, a tight fit between the pintle unit and the loops 13 and 15 along the full length of the sea is desired. The pintle units 31 and 32 are provided with a long, relatively gradual taper so that a tight fit along the complete length of the pintle unit can be provided. For a typical seam in a papermaker's fabric having an internal void diameter of about 50 mils, a pintle unit having a taper of about 0.075 mil/inch is effective for felts up to about 300 inches in width.

The long, gradual taper provides a pintle unit with a relatively constant size and wedging action to provide a tight fit, all along the seam, even if the pintle elements 31 and 32 are not each pulled into the seam in equal amounts or length. The taper provided on pintle elements 31 and 32 also facilitates insertion of the elements through passageway 20. When attaching swedge 40 to pintle elements 31 and 32, see FIG. 3, the pintle elements are oriented so that the diameter of pintle unit 30 is less than the diameter of passageway 20 so that they may easily fit through passageway 20. After orientation in passageway 20, swedge 40 is removed and ends 31*a* and 32*a* pulled in opposite direotions to oause the diameter of pintle unit to increase, filling passageway 20 and locking the seam.

Figure 2:
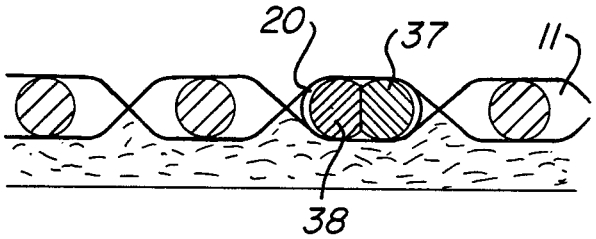
FIG. 2 is a cros section along line 2—2 of FIG. 1.

The relatively thin insertion ends 31*a* and 32*a* allow for the the elements 31 and 32 to oriented so as to be easily inserted simultaneously from opposite edges of the felt 10 if desired. The taper of the elements 31 and 32 further provides a wedging action when the elements 31 and 32 are pulled in opposite directions as indicated by arrows 41 and 42. The tapered portion of each element 31 and 32 may comprise a flat face 37 and 38, FIG. 2, formed on the pintle elements 31 and 32 respectively. During insertion of pintle elements 31 and 32 into passageway 20, flat faces 37 and 38, FIG. 2, are preferably oriented toward each other so that as the elements 31 and 32 are pulled through passageway 20 (arrows 41 and 42 of FIG. 1) the desired wedging action across the width of the seam is provided. Tightly wedging a pair of pintle elements 31 and 32 into passageway 20 provides a seam which is stronger than that provided by the use of a single pintle due to the locking force provided by the wedging action. However, the pintle elements are easy to insert into the passageway 20 due to the relationship which allows the pintle elements to be oriented in the passageway 20 and then pulled in opposite direction to interact and lock the seam in a wedging action.

As an aid in insertion of pintle elements 31 and 32 into passageway 20, a wire lead is preferably attached to swedge and ends 31*b* and 32*a* of elements 31 and 32 in a manner known in the art. Typically, after insertion and tightening of pintle elements 31 and 32 in passageway, the pintle elements 31 and 32 are severed at each edge 17 and 19 of the felt 10. The severed ends of the pintle elements 31 and 32 are then trimmed and fixed as by glueing, tying off, loop back insertion or heat staking to seal the seam and provide further control of the pintle in the felt 10 at the seam.

Figure 4:
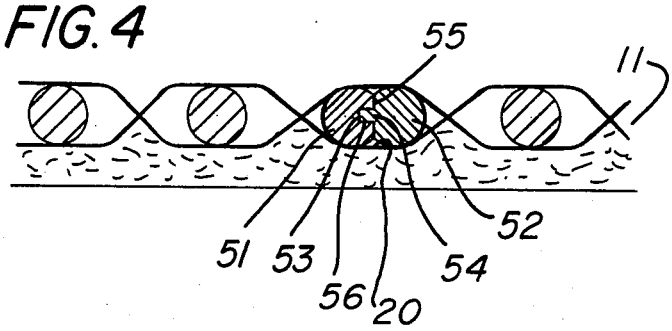
FIG. 4 is a cross section of an alternate embodiment of a papermaker's felt joined in accordance with the present invention.

In an alternate embodiment, as shown in FIG. 4, the tapered portion of the pintle elements 51 and 52 may be provided with a tongue and groove formation. In FIG. 4, first tapered pintle element 51 is provided with a groove 53 along the tapered surface 55. The second tapered pintle element 52 is provided with a corresponding tongue 54 along the tapered surface 56 adapted to fit within groove 53. Upon insertion of the pintle elements 51 and 52 into passageway 20, the tongue 56 is oriented within a groove 55 as the ends 51 and 52 are pulled in opposite directions into a wedging engagement within passageway 20.

In alternate embodiments, as shown in FIGS. 5, 8, and 11, the cross sectional configuration of the pintle elements 31 and 3 is altered. In FIG. 5 the tapered portion of the pintle elements 31 and 32 comprise concical tapered portions, FIG. 6. The tapered portions may be flat, FIG. 12, or zig-zagged FIG. 9, respectively and the pintle unit shaped so as to have a relatively square cross-sectional shape, FIGS. 9 and 12, while the insertion end is forced into a substantially round cross-section by swedge 40, FIGS. 7, 10 and 13. The rounded cross-section of the insertion end eases orientation of the pintle unit and swedge assembly in the passageway 20.

The wedging or locking action provided by the pintle element of the present invention provides a tight closing of the seam across the full width of the seam which reduces the potential for seam marks on the paper produced and also reduces seam bounce as the endless felt travels through the papermaking machine.

As noted, in the practice of the present invention, two pintle elements having tapered insertion ends are employed in closing a seam on a papermaker's felt. The tapered end of each element preferably extends for at least the width of the papermaker's felt to be seared. The tapered end of each pintle element is attached to a lead or insertion wire with a swedge or by other suitable means to aid in insertion. The lead wire of a pintle unit, or two such pintle elements are inserted through a passageway formed by alternating, intermeshing loops on the ends of the felt base fabric. The tapered pintle elements are pulled through the seam to tightly close the seam by filling the loops of the seam in a wedging action. The pintle elements are severed, trimmed and fixed after insertion to seal the seam.

From the above, it will be seen that a unique seam for a papermaker's felt is provided which tightly closes the seam yet which is easily and quickly made up by providing a pair of tapered pintle elements which are wedged into the seam of the felt.

It will be understood that various changes in th details, materials and arrangement of parts which have been herein described and illustrated in order to explain this invention may be made by those skilled in the art within the principle and scope of the invention as expressed in the following claims.

What is claimed is:

1. A method of closing a pin typed seam formed from a series of intermeshing loops of a fabric having a first and a second edge for use with papermaking equipment comprising the steps of:

(a) tapering each of at least two elongated pintle elements toward a respective first end of each pintle element, for a length at least the width of the seam, to form a tapered area on each pintle element;

(b) orienting said pintle elements in the intermeshing loops of said seam so that a first end of one of said pintle elements extends from the first edge of the seam and the first end of another one of said pintle elements extends from the second edge of the seam; and (c) pulling said tapered pintle elements into the seam by their respective first ends such that the tapered areas of said pintle elements contact to lock the seam in a wedging interaction.

2. The method of claim 1 further including the step of affixing an insertion guide wire to the respective first end of each of said pintle elements to aid insertion.

3. The method of claim 2, wherein said insertion guide wire is affixed to said pintle elements by a swedge.

4. The method of claim 1 wherein said one of said pintle elements includes means extending longitudinally along it to interact with means extending longitudinally along said another one of said pintle means.

5. In a pin type seam formed of intermeshing loops of a fabric, a pintle unit in the loops comprising:

at least two elongated pintle elements, each of said elemen tapered toward a respective first end thereof, for a length at least the width of the seam, to form a tapered area on each pintle element, said pintle elements oriented within said intermeshing so that the first end of one of said pintle elements extends from a first edge of the seam and the first end of another one of said pintle elements extends from a second edge of the seam with the respective tapered areas of said pintle elements in contact to lock the seam in a wedging interaction.

6. The pintle unit of claim 5 wherein said one of said pintle elements includes a flat area along its tapered portion to interact with a flat area along the tapered portion of said another one of said pintle elements in a wedging fashion to close said seam.

7. The pintle unit of claim 6 wherein said one of said of pintle elements includes a grove which receives a tongue on said another one of said pintle elements.

8. In a pin type seam formed of intermeshing loops of a papermakers fabric, a pintle unit in the loops comprising:

at least two elongated pintles elements, each of said pintle elements tapered toward a respective first end thereof for a length at least the width of the seam, to form a respective tapered area on each pintle element, said respective tapered area on at least one of said pintle elements extending in a direction opposite that of said another pintle, said pintle elements oriented within said intermeshing loops so that the first end of one of said pintle elements extends from a first edge of the seam and the first end of said another one of said pintle elements extends from a second edge of the seam with the respective oppositely tapered areas of said pintle elements in contact to lock the seam in a wedging interaction.

9. The pintle unit of claim 8 wherein said one of said tapered pintle elements includes a flat area to interact with a flat area on the oppositely tapered pintle and lock said seam in a wedging fashion.

10. The pintle unit of claim 9 wherein said flat area of said one of said pintle elements includes a groove which receives a tongue on said flat area of said oppositely tapered pintle element.

11. The pintle unit of claim 9 wherein the flat tapered areas include complimentary zig-zag surfaces.

* * * * *

UNITED STATES PATENT AND TRADEMARK OFFICE

CERTIFICATE OF CORRECTION

PATENT NO. : 4,806,208

DATED : February 21, 1989

INVENTOR(S) : Patrick H. Penven

It is certified that error appears in the above-identified patent and that said Letters Patent is hereby corrected as shown below:

Column 1, line 32, delete the "-" between the words "curved-profile".

Line 54, delete the word "havy" and insert therefor --heavy--.

Line 64, delete the word "a" and insert therefor --an--.

Column 2, line 27, delete the word "cros" and insert therefor --cross--.

Line 53, delete the word "th" and insert therefor --the--.

Line 56, after the word "invention" and before the word "this" insert --,--.

Line 58, delete the word "appende" and insert therefor --appended--.

Line 59, delete the word "papermaker,s" and insert therefor --papermaker's--.

Column 3, line 8, delete the word "papermaker,s" and insert therefor --papermaker's--.

UNITED STATES PATENT AND TRADEMARK OFFICE

CERTIFICATE OF CORRECTION

PATENT NO. : 4,806,208

DATED : February 21, 1989

INVENTOR(S) : Patrick H. Penven

It is certified that error appears in the above-identified patent and that said Letters Patent is hereby corrected as shown below:

Column 3, line 55, after the word "felt" and before the word "to" insert reference numeral --10--.

Line 61, delete the word "sea" and insert therefor --seam--.

Column 4, line 13, delete the word "direotions" and insert therefor --directions--.

Line 13, delete the word "oause" and insert therefor --cause--.

Line 42, after the word "swedge" and before the word "and" insert reference numeral --40--.

Line 65, delete reference numeral "3" and insert therefor --32--.

Column 5, line 17, delete the word "seared" and insert therefor --seamed--.

UNITED STATES PATENT AND TRADEMARK OFFICE

CERTIFICATE OF CORRECTION

PATENT NO. : 4,806,208

DATED : February 21, 1989

INVENTOR(S) : Patrick H. Penven

It is certified that error appears in the above-identified patent and that said Letters Patent is hereby corrected as shown below:

Column 5, line 34, delete the word "th" and insert therefor --the--.

Claim 5, column 6, line 13, delete the word "elemen" and insert therefor --elements--.

Claim 5, column 6, lines 16 and 17, after the word "intermeshing" and before the word "so" insert therefor --loops--.

Signed and Sealed this

Third Day of October, 1989

*Attest:*

*Attesting Officer*

DONALD J. QUIGG

*Commissioner of Patents and Trademarks*